US010240453B2

(12) United States Patent
Goodman

(10) Patent No.: US 10,240,453 B2
(45) Date of Patent: Mar. 26, 2019

(54) SOLID STATE PHASE CHANGE FLASKING FOR A DOWNHOLE TOOL COMPONENT

(71) Applicant: Schlumberger Technology Corporation, Sugar Land, TX (US)

(72) Inventor: Kenneth Randall Goodman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 571 days.

(21) Appl. No.: 14/899,464

(22) PCT Filed: Jun. 17, 2014

(86) PCT No.: PCT/US2014/042622

§ 371 (c)(1),
(2) Date: Dec. 17, 2015

(87) PCT Pub. No.: WO2014/204891

PCT Pub. Date: Dec. 24, 2014

(65) Prior Publication Data

US 2016/0145996 A1 May 26, 2016

Related U.S. Application Data

(60) Provisional application No. 61/835,673, filed on Jun. 17, 2013.

(51) Int. Cl.

| | |
|---|---|
| ***E21B 47/01*** | (2012.01) |
| ***E21B 36/00*** | (2006.01) |
| ***E21B 43/1185*** | (2006.01) |

(52) U.S. Cl.
CPC ..... *E21B 47/011* (2013.01); *E21B 36/001* (2013.01); *E21B 36/003* (2013.01); *E21B 43/1185* (2013.01)

(58) Field of Classification Search
CPC .... E21B 47/011; E21B 36/001; E21B 36/003; E21B 43/1185
See application file for complete search history.

(56) References Cited

U.S. PATENT DOCUMENTS

| | | | |
|---|---|---|---|
| 4,572,864 | A | 2/1986 | Benson et al. |
| 5,315,154 | A | 5/1994 | Elwell |
| 7,673,566 | B2 | 3/2010 | Han et al. |
| 2007/0095543 | A1 | 5/2007 | Tchakarov et al. |
| 2011/0042075 | A1 | 2/2011 | Hammami et al. |

OTHER PUBLICATIONS

PCT/US2014/042622 International Search Report and Written Opinion dated Oct. 8, 2014, 15 pgs.
International Preliminary Report on Patentability issued in the related PCT application PCT/US2014/042622, dated Dec. 22, 2015 (11 pages).

*Primary Examiner* — Wei Wang

(57) ABSTRACT

A heat sink of solid state phase change material for a heat sensitive downhole tool component. The heat sink may be of a polyhydric alcohol based or other suitable material which is capable of undergoing a phase change from one solid form to another. That is, the phase change material need not undergo a phase change into a liquid form in order to absorb well heat and provide substantial protection to the heat sensitive downhole tool component. Thus, cost effectiveness, manufacturability and performance may all be enhanced which may be particularly advantageous where the component is of a single application use variety.

19 Claims, 6 Drawing Sheets

SOLID STATE PHASE CHANGE FLASKING FOR A DOWNHOLE TOOL COMPONENT

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, in order to ensure efficiency of well operations, an added amount of emphasis may be placed on initial well evaluations, as well as subsequent monitoring and more direct interventions throughout the life of the well.

From the outset of operations, complex logging applications utilizing sophisticated electronic components may be run in the well in order to establish an initial overall profile of the well. Additionally, subsequent interventions may be run to complete and manage the well over time. These interventions may range from the complex installation of completions equipment to more abrupt perforating interventions as part of stimulating operations and a host of other intervention types as well.

In the case of logging applications, sensitive electronic components are utilized that generally include some form of heat related protection. For example, a logging tool may include a heat sensitive board and various pressure, temperature and other sensors that would be susceptible to failure upon direct exposure to extreme heat. Indeed, it is not uncommon for the majority of such components to be rated to effectively operate in temperatures that are under about 200° C. (or 400° F.). However, once the tool reaches a depth of several thousand feet, which is generally expected in today's wells, temperatures may exceed 400° F. or more. Thus, as noted above, such heat sensitive components are sometimes afforded heat related protection in the form of flasking.

Heat sensitive components of a logging tool, or any downhole tool, may be housed within a flask. A flask is a structure that includes a heat sink type of casing about the tool or component that is configured to absorb heat from the surrounding environment. The flask will generally also include insulation located about the heat sink to serve as an outer shield to the heat. Flasking heat sensitive components in this manner serves to delay failure-level heat from reaching the heat sensitive components for hours. That is, an application may be run and completed before the heat sensitive components are ever actually exposed to a level of heat sufficient to effect component failure.

Flasking in the manner described above is usually most effective where a Dewar type flasking is utilized. This means that the heat sink may be retained within a multi-walled structure which itself surrounds the heat sensitive component or tool. This allows the heat sink to be of a highly effective phase change material. For example, as opposed to a solid stainless steel or other more static material, the heat sink may be of a bismuth-based or other suitable phase change material which moves from a solid to a more liquid form as heat is absorbed. Phase change materials such as these have been established as extremely effective in absorbing heat and protecting underlying heat sensitive components from the more extreme temperatures of the well.

Unfortunately, utilizing a solid to liquid phase change material as described for the heat sink means that a new risk of exposure is now presented to underlying sensitive tool components. Specifically, the risk of exposing the sensitive components to a melting wax-like substance or other liquid is now presented. As noted, this means that the multi-walled Dewar-type flask is needed to retain the heat sink material. However, this presents a host of manufacturability challenges, for example, when keeping in mind the needed wiring into and out of the flask to reach the protected components. Indeed, a sophisticated manufacturing process of wiring, filling and sealing the multi-walled Dewar structure with the heat sink material may be required. In today's dollars, for a conventional 5-10 foot logging tool, this may translate into well over $40,000 dedicated to flasking alone.

Even more problematic than the expensive flasking for a reusable logging tool as described above is the circumstance where such flasking is desired for a single use application. For example, where the heat sensitive component at issue is a detonator of a perforating gun to be used once and then destroyed during the perforating application, the most effective flasking option detailed above remains generally impractical due to the costs involved. Nevertheless, the attempt may be undertaken due to the hazardous nature of the application where failure potentially results in premature detonation. Unfortunately, while such efforts are often less than reliable the costs are also quite high as noted above.

SUMMARY

A downhole tool assembly is provided for positioning in a well. The assembly includes a heat sensitive component of a tool that is located within a heat sink of a flask structure. The heat sink is configured for absorbing heat of the well and is of a solid state phase change material. In one embodiment, this material is a polyhydric alcohol based material.

DETAILED DESCRIPTION

Embodiments are described with reference to flasking with a solid state phase change heat sink utilized to protect a heat sensitive tool component from extreme well temperatures. Specifically, the embodiments depict a heat sensitive tool component in the form of a detonator for a wireline delivered perforating gun. However, any number of different types of heat sensitive downhole tool components may benefit from this type of flasking. For example, a variety of different sensors and other instruments for a logging tool, or even an entire logging tool may be flasked according to embodiments detailed herein. Regardless, so long as the flask structure includes a heat sink of a solid state phase change material, appreciable benefit may be realized.

As used herein, the term "solid state phase change material" is meant to refer to materials that undergo a phase change from solid to solid as opposed to directly transitioning from a solid to a liquid. Indeed, the term "solid-solid phase change material" may also be utilized herein to describe these types of materials. As described further below, these materials may include solid polyhydric alcohols and others which, as surrounding temperatures are increased and a heat of absorption reached, tend to undergo an initial phase change transition from a first solid molecular arrangement to a second solid molecular arrangement. Thus, even though a beneficial phase change takes place in terms of heat sink performance, the heat sink material may avoid being converted to a liquid.

Figure 1:
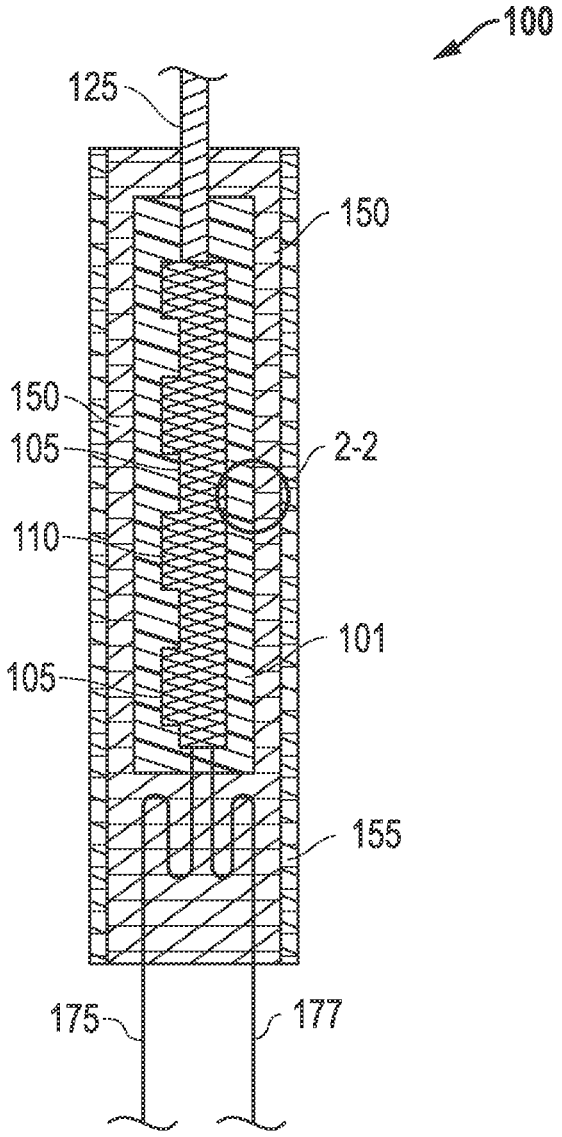
FIG. 1 is a side cross-sectional view of an embodiment of a flasked heat sensitive downhole tool component utilizing a heat sink of solid state phase change material.

Referring now to FIG. 1, a side cross-sectional view of an embodiment of a flask assembly 100 is shown. The assembly 100 includes a heat sensitive downhole tool component 110 located within a flask structure. Specifically, the flask structure includes a heat sink 101 that is of a solid state phase change material (often referred to as a solid-solid phase change material). That is, the heat sink 101 is configured to absorb heat of a surrounding environment such as that of a well 380 while undergoing a phase change transition from one solid form to another solid form (see FIG. 3). With particular reference to the assembly 100 of FIG. 1, this means that the heat sink 101 may be directly adjacent the underlying heat sensitive component 110 without undue concern over the heat sink 110 taking on a liquid form during phase change. Thus, from a manufacturability standpoint, this means that a more challenging multi-walled Dewar structure or other sophisticated architecture need not be utilized for protecting the heat sensitive component (e.g. from an adjacently melting heat sink).

Continuing with reference to FIG. 1, the flask structure of the embodiment shown also includes insulating layers 150, 155 which contain the heat sink 101 and underlying heat sensitive component 110. In one embodiment, the primary insulating body 150 may be a conventional fiberglass, fibrous moldable material, ceramic or foam for securely housing the heat sink 101 and heat sensitive component 110. The assembly 100 may then be completed with an outer insulating layer 155 of insulating tape wrapped about underlying insulating body 150.

As alluded to above, in the depicted assembly, the heat sensitive component 110 is an electrically actuated detonator. Although, in other embodiments, the detonator 110 may be responsive to optical signals, pressure pulses or other modes of communication. Regardless, for the electrical detonator 110 shown, a detonator cord 175 and surface communication line 177 are shown emerging from one end of the assembly 100 whereas a coupling line 125 is shown emerging from the other end, for example to attach to a wireline cable 310 (see FIGS. 3 and 4). However, securing such lines 125, 175, 177 to the detonator 110 requires only that suitable accommodating channels be formed through the uniform structures of the insulating body 150 and heat sink 101. That is, as opposed to more complex penetrating and sealing of multi-walled Dewar type architecture, the insulating body 150 and heat sink 101 may be of relatively monolithic solid forms that accommodate the lines 125, 175, 177 by more straight forward channeling or even by being molding thereover.

As opposed to a uniform block, the detonator 110 of FIG. 1 is likely to include an irregular outer profile or surface 105. This is due to the fact that an electrical detonator 110 is likely to include a circuit board with various subcomponents mounted thereon such as a receiver, transmitter, microprocessor and other features to support effective communications and responsiveness relative a surface controller 365 (see FIG. 3). However, in spite of this irregular outer surface 105, the heat sink 101 of the embodiment shown may be shaped to directly conformally accommodate and interface with the detonator 110. This may be achieved by reductively carving out an appropriate space to accommodate the detonator 110 or by molding the heat sink material thereabout. Regardless, the assembly 100 is left with a detonator 110 that is not only enhanced in terms of protection from surrounding heat but also securely held in a manner that may avoid any undue rattling against the heat sink 101 itself during transport or use.

All in all, the assembly 100 of FIG. 1 may be 5-15 inches in length with an outer diameter of 0.5-3 inches and include a variety of components as noted above. However, due to the straight forward design afforded by use of a solid state heat sink 101, manufacturability costs may be reduced to a level where the entire assembly 100 runs no more than a couple hundred dollars. This is particularly beneficial where the assembly 100 is for a single use device such as a detonator 110 as described here. Nevertheless, this same type of architecture with a solid state heat sink 101 may be utilized in much larger assemblies such as for logging tools so as to achieve a similarly dramatic reduction in manufacturing costs. Further, whether for a small detonator or comparatively larger logging tool, improved reliability may also be attained due to the security and reliability afforded by the comparatively more precisely shapable heat sink 101 as described above.

Figure 2A:
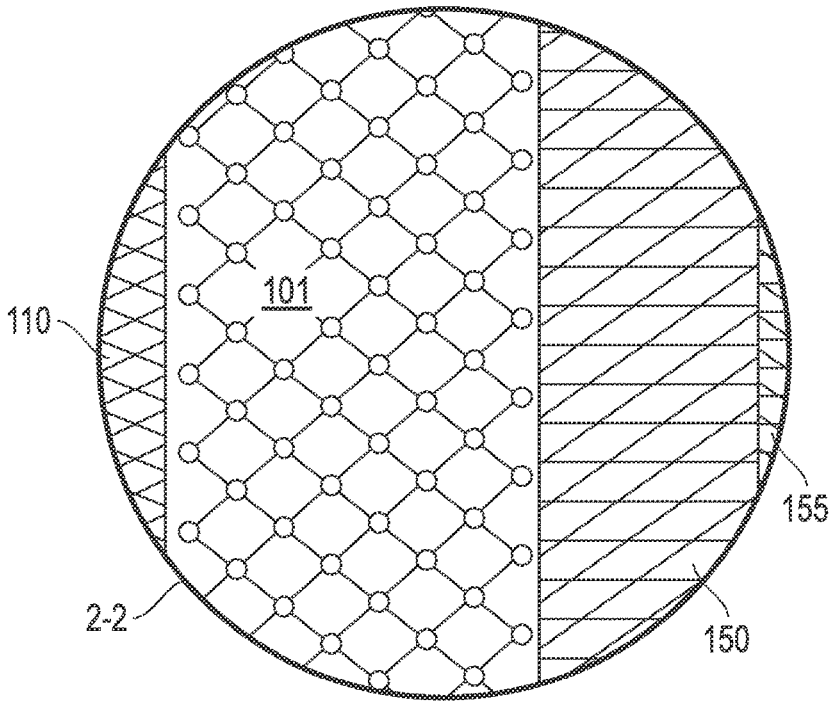
FIG. 2A is an enlarged view of a portion of the heat sink taken from 2-2 of FIG. 1 with the material thereof in a first solid state phase.

Referring now to FIG. 2A, an enlarged view of a portion of the heat sink 101 is shown taken from 2-2 of FIG. 1. In this embodiment, the material that makes up the heat sink 101 is graphically depicted in a first solid state phase. For example, the material may be a highly ordered crystalline structure or lattice. Of course, the depiction is merely shown in an illustrative, schematic-type form and not meant to suggest or require any precise molecular arrangement for the material. However, as noted above, just like an adjacent detonator 110 and/or insulating layers 150, 155, the material of the heat sink 101 is solid at conventional surface and downhole temperatures (e.g. anywhere below several hundred degrees Celcius).

As also described above, the material of the heat sink 101 is a solid state (or solid-solid) phase change material. A variety of different polyhydric alcohols may exhibit solid state phase change characteristics and be well suited for construction of a heat sink 101. The particular material chosen may include a variety of additives or fillers and be tailored to the application at hand. For example, workability in terms of manufacturing an assembly 100 such as that of FIG. 1 may be considered as well as suitability for exposure to downhole temperatures of a particular well 380 such as that of FIG. 3.

Figure 2B:
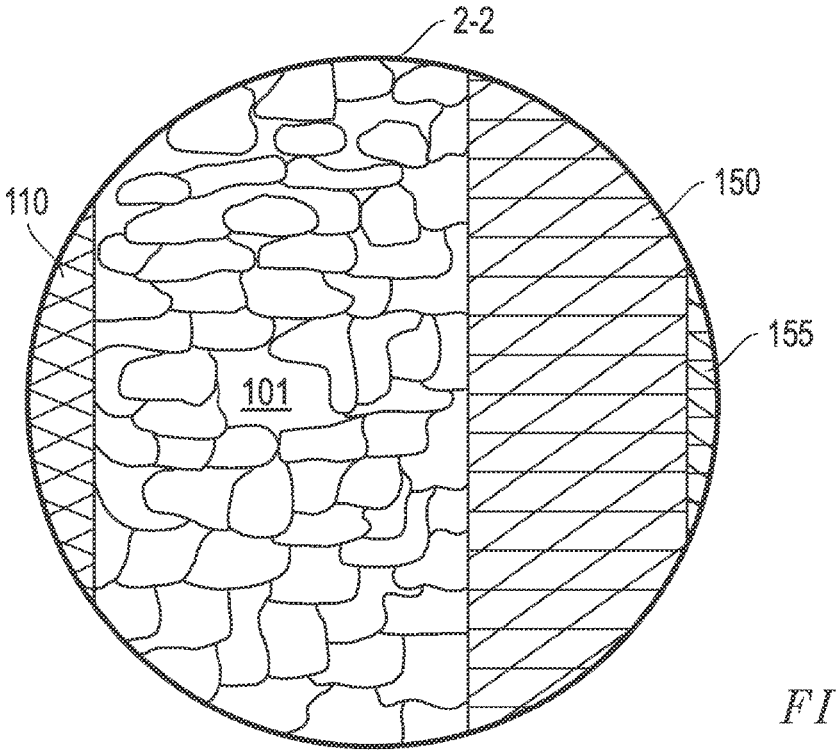
FIG. 2B is the enlarged view of FIG. 2A with the material of the heat sink transitioned into in a second solid state phase.
Figure 3:
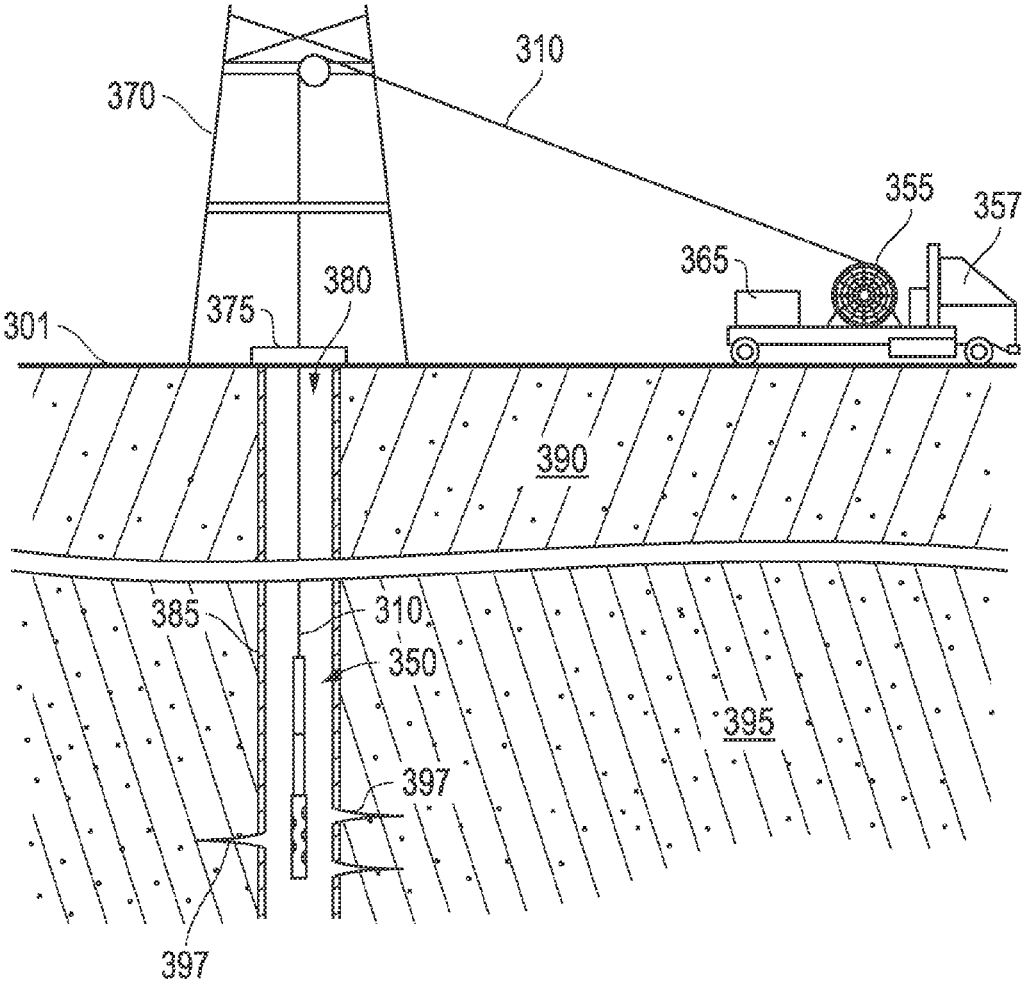
FIG. 3 is an overview of an oilfield accommodating a well where a perforating gun is positioned which employs the flasked heat sensitive downhole tool component of FIG. 1.

With added reference to FIG. 3, once the assembly of FIG. 1 is incorporated into a downhole tool 350, it may be deployed into a well 380 and begin to be subjected to high downhole temperatures. Indeed, at some point, regardless of the particular material selected for the heat sink 101, a phase transition thereof may occur. For example, in an embodiment utilizing a polyhydric alcohol, a heat of transition may emerge at between about 325° F. and about 375° F. At this transition, the molecular arrangement may "transition" from that graphically illustrated in FIG. 2A to another arrangement as illustrated in FIG. 2B.

Referring specifically now FIG. 2B, the enlarged view of FIG. 2A is shown with the material of the heat sink 101 transitioned into in a second solid state phase. That is, a transition is or has taken place in which energy is absorbed by the heat sink material. However, as also indicated above, this transition is not one where the material moves to a liquid form. Rather, in the illustrated embodiment, the material moves from a more ordered arrangement to a more amorphous arrangement. As with more conventional solid-liquid phase change materials, this offers a degree of heat protection to underlying heat sensitive components 110. However, unlike more conventional phase change materials, this protection is afforded in a manner which does not involve the emergence of a liquid. This may be particularly beneficial given that this occurs adjacent a heat sensitive component 110 which is likely electronic or otherwise susceptible to failure upon exposure to liquids. Thus, the need for a separate chamber for the heat sink material is not a requirement to the overall architecture of the assembly 100 of FIG. 1. Of course, embodiments may be constructed which nevertheless incorporate such architecture where so desired.

Referring now to FIG. 3 is an overview of an oilfield 301 is shown accommodating a well 380 where a perforating gun 350 is positioned. The gun 350 employs the flasked heat sensitive downhole tool component 110 of FIG. 1. More specifically, the component 110 may be a detonator for the gun 350 as noted above. The gun 350 and entire assembly 100 of FIG. 1 may be assembled offsite and later delivered to the oilfield 301 and secured to a wireline cable 310. The gun 350 may then be deployed from a wireline truck 357. Guidance from a surface controller 365 and supportive rig 370 may be utilized as the gun 350 is advanced past a wellhead 375 and various formation layers 390, 395 to a perforating location in the well 380. Once reaching the predetermined location for perforating, the controller 365 may signal the detonator 110 of the gun 350 to trigger perforating to form perforations 397 through casing 385 which defines the well 380. Thus, various flow paths from the formation 395 and into the main bore of the well 380 may be formed.

With added reference to FIG. 1 and as suggested above, the depths of the well 380 at the location of the perforating may be several thousand feet below the oilfield surface 301. This may be commensurate with temperatures exceeding 400° F. (or a little over 200° C.) and likely above temperature ratings of heat sensitive components of the gun 350 such as the detonator 110. Nevertheless, a solid state heat sink 101 may be utilized to effectively protect the detonator 110 for the likely duration of the perforating application and in a manner that substantially avoids the emergence of any fluid exposure to such heat sensitive components.

Of course, as noted above, in other embodiments, components apart from detonators may be effectively protected in a similar manner with a solid state heat sink 101 as part of a flask structure. This may include logging and other downhole tool components. Additionally, the mode of conveyance for such tools may be by modes other than by wireline as depicted. For example, coiled tubing, slickline or any number of other conveyance modes may be utilized depending upon the application at hand as well as the architecture of the well 380.

Figure 4:
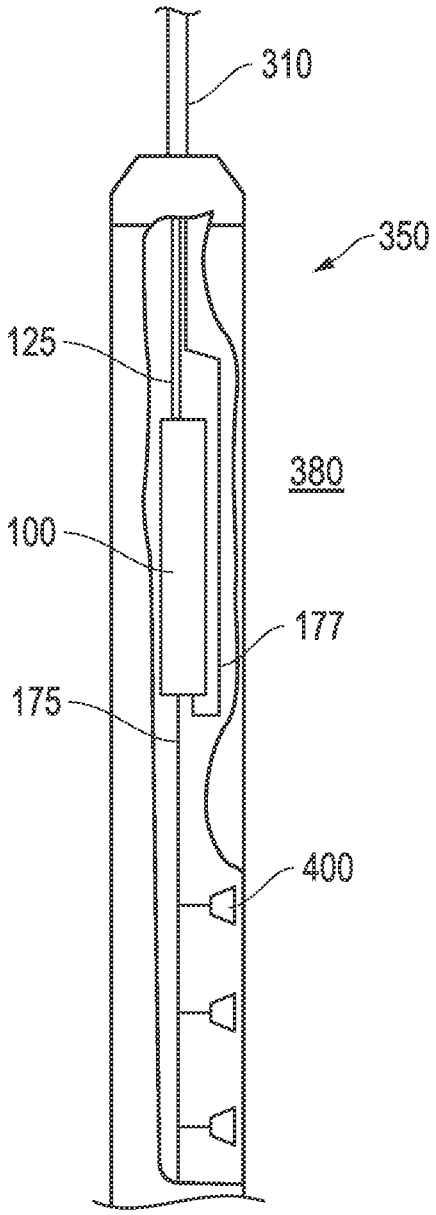
FIG. 4 is an enlarged partially sectional view of the perforating gun of FIG. 3 revealing the flasked heat sensitive downhole tool component of FIG. 1 therein.

Referring now to FIG. 4, an enlarged partially sectional view of the perforating gun 350 of FIG. 3 is shown. With added reference to FIG. 1, this partially sectional view reveals the environment in which the detonator assembly 100 is located. Specifically, the assembly 100 is maintained within the gun 350 and includes wiring 125, 175, 177 emerging therefrom. This may include a detonator cord 175 running to shaped charges 400 for the triggering of the above described perforating. Additionally, an electronic surface communication line 177 may emerge from the assembly 100. Thus, signaling of the detonator 110 to initiate the perforating may take place via surface commands as also indicated above. Further, a coupling line 125 connects to the wireline 310 as shown as does the noted communication line 177. Regardless, of the particular architecture, the heat sensitive component of a detonator 110 is protected from temperatures of the surrounding environment of the well 380.

Figure 5:
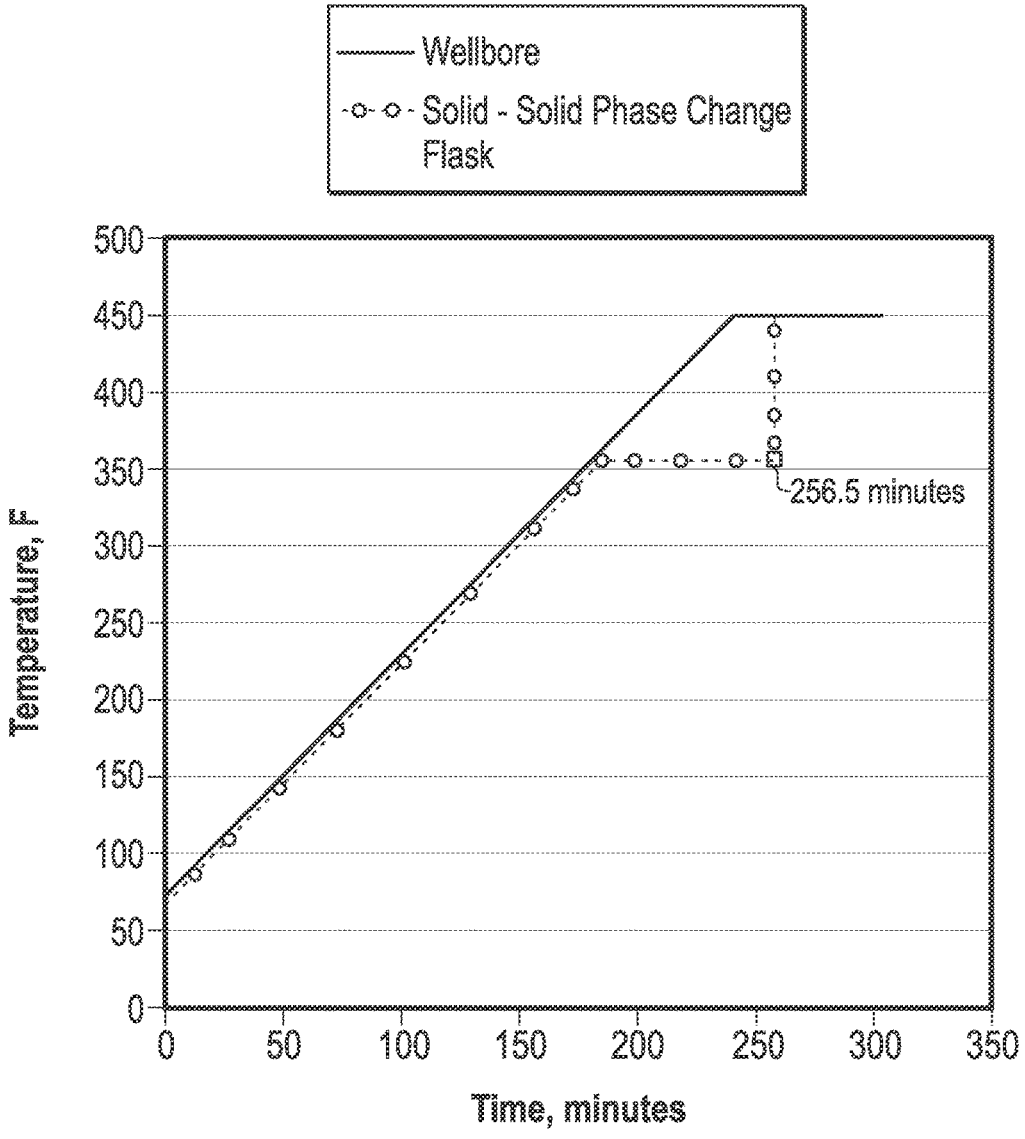
FIG. 5 is a chart depicting the temperature effect on the heat sensitive downhole tool component as the heat sink of FIG. 1 transitions from a first solid phase to a second solid phase.

Referring now to FIG. 5, a chart depicting the temperature effect on the heat sensitive downhole tool component is shown. The chart also depicts the wellbore temperature as it is without regard to any particular heat sink or flasking. Specifically, a solid line which reaches a maximum temperature of about 450° F. and then flattens out is shown. This is consistent with a well that is at 450° F. at a maximum depth. Thus, in terms of application time as reflected along the x-axis of the chart, once the maximum depth is reached, the temperature no longer increases beyond the 450° F. of the well at this depth.

By way of contrast to the well temperature, the chart also depicts the temperature effect on the heat sensitive downhole tool component (see "solid-solid phase change flask"). Specifically, as the heat sink 101 of FIG. 1 is lowered further into the well 380 of FIG. 3, the material thereof transitions from a first solid phase to a second solid phase. It is during this period of transition that heat energy of the surrounding well environment is absorbed by the solid state heat sink 101 or "solid-solid phase change flask", thereby preventing continued rise in temperature of the underlying heat sensitive component. As noted above, this is achieved in a manner that avoids the formation of liquid due to this particular transition. As depicted in the chart of FIG. 5, this involves a heat of absorption taking place at a little over 350° F. for the particular solid state material utilized. So, for example, where a heat sensitive component protected by such a material is rated effective at temperatures of up to 375° F., the heat sink will begin to transition before this temperature is reached. Thus, the hazardous temperature of 375° F. is prevented from being reached at the underlying heat sensitive component, at least for a while.

Of course, depending on the volume of the heat sink and overall absorbative capacity, the amount of energy that may be stored during transition will eventually be reached. Thus, as indicated in the chart of FIG. 5, the solid-solid phase change flask begins to transition at about 355° F. and continues to absorb heat for about 80 minutes (from about 175 minutes into a well application until a little over 250 minutes). In other words, for the better part of an hour and a half of phase change transition time, the solid-solid phase change flask effectively assures that the underlying heat sensitive component is protected from the hazardous temperature of 375° F. Further, as indicated above, the solid-solid phase change flask may be larger or smaller depending on the amount of protective time is sought, depending on the length of the downhole application at hand while exposed to well temperatures of consequence.

Figure 6:
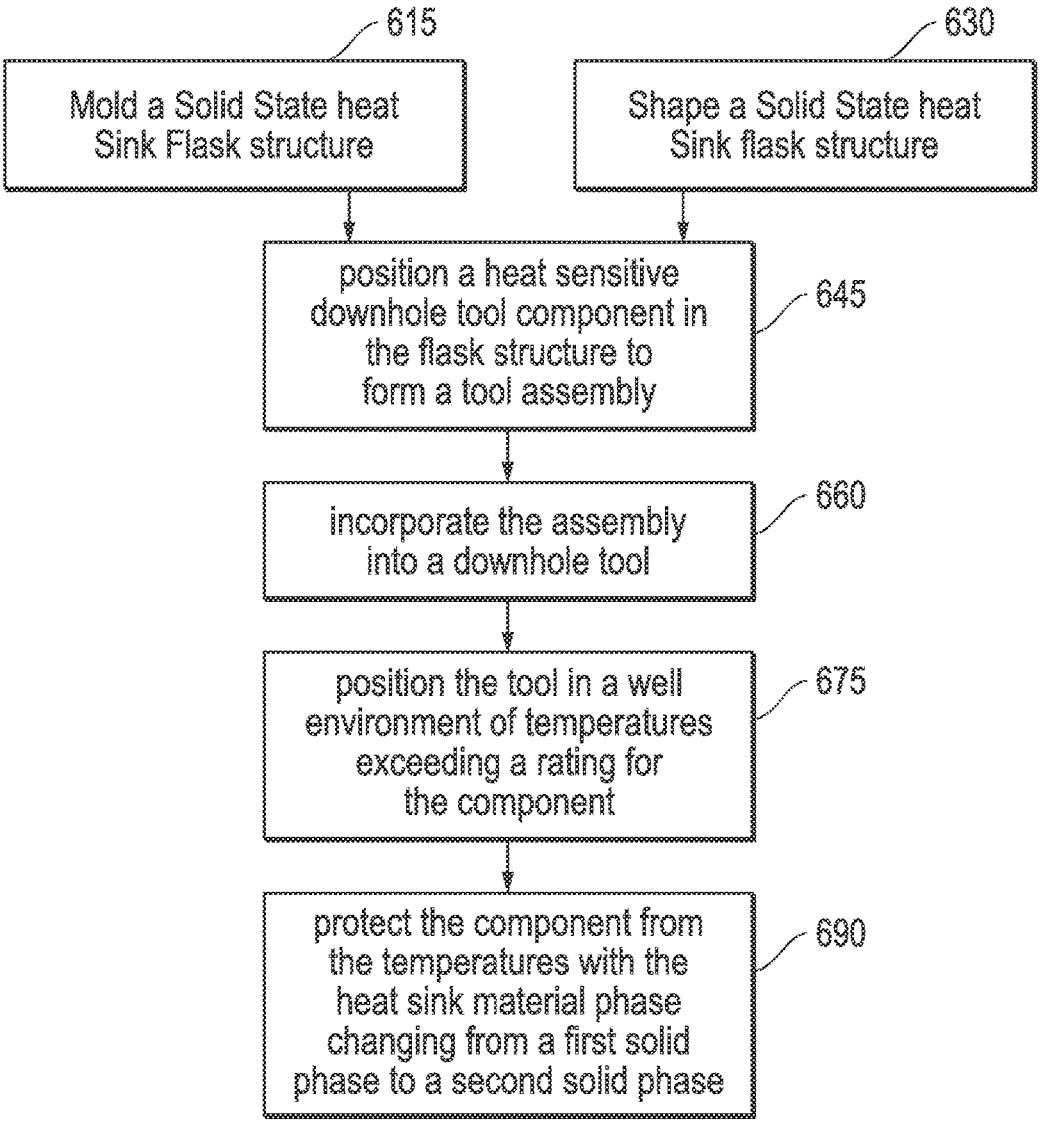
FIG. 6 is a flow-chart summarizing an embodiment of assembling and utilizing a flasked downhole tool component with a heat sink of sold state phase change material.

Referring now to FIG. 6, a flow-chart summarizing an embodiment of assembling and utilizing a flasked downhole tool component with a heat sink of sold state phase change material is shown. The solid state heat sink material for the flask structure may be molded about the heat sensitive downhole tool component or otherwise shaped to accommodate the component (see 615, 630, 645). The assembly may be completed with the addition of structural or further insulating layers thereabout. The assembly may then be incorporated into a downhole tool as indicated at 660.

With the tool complete, it may be positioned in a well where temperatures exceed the rating for the heat sensitive component as indicated at 675. Nevertheless as noted at 690, the component may be protected from exposure to such temperatures as the heat sink material phase changes from one solid phase to another, thereby absorbing the hazardous heat.

Embodiments described hereinabove include a flasking structure with a heat sink that performs without substantial risk of phase transition to a liquid phase. Yet, the heat sink material does undergo a phase transition for enhanced performance. Thus, damage to underlying heat sensitive components may be better avoided both in terms of protection from heat and liquid exposure to the components. Once more, the expense of such a heat sink may be kept to a minimum where desired due to the ability to render an effective heat sink without the requirement of more complex multi-walled (or separate chambered) architecture. So, for example, even in circumstances where the component is for a single use application, the sacrifice which takes place may be dramatically less substantial in terms of cost.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, in one embodiment, the solid state heat sink material may transition from one solid to another at one temperature (e.g. below about 400° F.) while also being capable of another solid-liquid phase change at another temperature (well above 400° F.). This would involve the use of an added chamber to protect underlying heat sensitive tool components. However, it would also substantially add to the overall effectiveness of the heat sink to protect the underlying component from the heat of the well. Furthermore, the foregoing description should not be read as pertaining only to the precise structures described and shown in the accompanying drawings, but rather should be read as consistent with and as support for the following claims, which are to have their fullest and fairest scope.

I claim:

1. A downhole tool assembly for deploying into a well the assembly comprising:

a heat sensitive component; and a flask structure including a heat sink about the component for absorbing heat of the well, wherein the heat sink comprises a solid state phase change material, a primary insulating body about the heat sink, and an outer insulating layer about the primary insulating body.

2. The tool assembly of claim 1 wherein the heat sensitive component is one of a detonator for a perforating gun and a logging tool component.

3. A flask structure for protecting a heat sensitive component of a downhole tool from heat within a well at an oilfield, the structure comprising a solid state phase change heat sink located about the heat sensitive component, a primary insulating body about the heat sink; and an outer insulating layer about the primary insulating body.

4. The flask structure of claim 3 wherein the heat sink is of a polyhydric alcohol based material.

5. The flask structure of claim 3 wherein the heat sink forms a conformal interface with an irregular surface of the heat sensitive component.

6. The flask structure of claim 3 further comprising at least one insulating layer about the heat sink.

7. The flask structure of claim 6 further comprising at least one line coupled to the heat sensitive component, the line disposed through the heat sink and the insulating layer.

8. The flask structure of claim 7 wherein the line is one of a detonator cord and a line to support communication with equipment at a surface of the oilfield adjacent the well.

9. The flask structure of claim 3 wherein the primary insulating body is one of a fibrous moldable material, a ceramic and a foam.

10. The flask structure of claim 3 wherein the outer insulating layer is insulating tape.

11. A method of manufacturing a downhole tool assembly, the method comprising:

conformally molding a solid state heat sink material about a heat sensitive downhole tool component;

locating the heat sink outfitted component within a primary insulating body;

wrapping the primary insulating body with an outer insulating layer;

positioning the insulated heat sink outfitted component assembly within a tool for deployment into a well to perform a downhole application at well temperatures exceeding a temperature rating for the heat sensitive downhole tool component.

12. The method of claim 11 further comprising coupling at least one line to the heat sensitive downhole tool component prior to the conformally molding of the solid state heat sink material.

13. A method of performing a downhole application in a well at a location exceeding a given well temperature, the method comprising:

positioning an application tool at the location, the application tool having a heat sensitive component rated to a temperature below that of the given well temperature;

protecting the heat sensitive component with a heat sink comprised of a solid state phase change material surrounding the heat sensitive component, a primary insulating body about the heat sink; and an outer insulating layer about the primary insulating body.

14. The method of claim 13 wherein the protecting comprises:

absorbing heat of the well at the location with the heat sink; and transitioning the solid state phase change material from a first solid state molecular arrangement to a second solid state molecular arrangement different than the first solid state molecular arrangement, both molecular arrangements being non-liquid.

15. The method of claim 14 wherein the protecting further comprises shielding the heat sensitive component from heat of the well with an insulating layer thereabout.

16. The method of claim 13 wherein the application tool is not reusable.

17. The method of claim 16 wherein the heat sensitive component is a detonator and the application tool is a perforating gun.

18. The method of claim 13 wherein the solid state phase change material is a polyhydric alcohol based material.

19. The method of claim 13 wherein the solid state phase change material surrounding the heat sensitive component includes conformally interfacing the material with an irregular surface of the heat sensitive component.

* * * * *